US006080088A

United States Patent [19]

Petersen et al.

[11] Patent Number: 6,080,088

[45] **Date of Patent: *Jun. 27, 2000**

[54] EXERCISE MACHINE

[75] Inventors: Paul S. Petersen, Minnetonka, Minn.; James F. Ster, Jr., Citrus Heights, Calif.

[73] Assignee: Bioform Engineering, Inc., Ross, Calif.

[ * ] Notice: This patent is subject to a terminal disclaimer.

[21] Appl. No.: 08/476,307

[22] Filed: Jun. 7, 1995

(Under 37 CFR 1.47)

Related U.S. Application Data

[63] Continuation of application No. 08/198,081, Feb. 16, 1994, Pat. No. 5,542,893, which is a continuation of application No. 07/491,670, Mar. 8, 1990, abandoned.

[51] Int. Cl.[7] ..... A63B 69/06; A63B 22/12

[52] U.S. Cl. ..... 482/72; 280/245; 482/62; 74/131

[58] Field of Search ..... 482/57, 62–63, 482/72, 52; 280/245, 246, 254, 258

[56] References Cited

U.S. PATENT DOCUMENTS

| | | | |
|---|---|---|---|
| 305,198 | 9/1884 | Kempster . | |
| D. 306,892 | 3/1990 | Pitzen et al. | D21/194 |
| 433,202 | 7/1890 | Herrick . | |
| 968,355 | 8/1910 | Hopkins . | |
| 1,171,763 | 2/1916 | Allen . | |
| 1,273,079 | 7/1918 | Matson et al. . | |
| 1,412,276 | 4/1922 | Dahl . | |
| 1,518,661 | 12/1924 | McElroy, Jr. et al. . | |
| 2,085,657 | 6/1937 | Heisdorf . | |
| 2,114,648 | 4/1938 | Bevier . | |
| 2,464,952 | 3/1949 | Warburton . | |
| 3,134,378 | 5/1964 | Harwood . | |
| 3,205,725 | 9/1965 | Uhtenwoldt . | |
| 3,877,724 | 4/1975 | Chase | 280/241 |
| 3,891,235 | 6/1975 | Shelly | 280/252 |
| 4,169,609 | 10/1979 | Zampedro | 280/241 |
| 4,188,030 | 2/1980 | Hooper | 272/73 |
| 4,508,358 | 4/1985 | Erel | 280/234 |
| 4,728,099 | 3/1988 | Pitre | 272/72 |
| 4,729,559 | 3/1988 | McNeil | 272/73 |
| 4,762,317 | 8/1988 | Camfield et al. | 272/73 |
| 4,858,483 | 8/1989 | Blakemore | 74/143 |
| 4,923,193 | 5/1990 | Pitzen et al. | 272/73 |
| 4,961,569 | 10/1990 | Roberge | 272/73 |
| 5,007,655 | 4/1991 | Hanna | 280/250 |
| 5,050,864 | 9/1991 | Pertramer | 272/73 |

*Primary Examiner*—John P. Leubecker
*Attorney, Agent, or Firm*—Kinney & Lange, P.A.

[57] ABSTRACT

The apparatus converts reciprocating motion of a rowing type exercise into single direction rotational motion of a shaft in a predetermined direction. A reciprocable arm of a rowing type exercise is pivotally mounted to a frame. A shaft, set for rotation in the frame has first and second one way clutches. First and second racks are mounted with respect to the reciprocable arm and engage one or the other of the one way clutches for driving the shaft in a predetermined direction of rotation as the arms are reciprocated. One or the other clutches freewheels against its respective rack when one of the racks is moved in to drive the shaft and thereby retains the driving rack in engagement with its respective one way clutch.

17 Claims, 8 Drawing Sheets

EXERCISE MACHINE

This is a Continuation of U.S. application Ser. No. 08/198,081, filed Feb. 16, 1994, now U.S. Pat. No. 5,542, 893. U.S. application Ser. No. 08/198,081, filed Feb. 16, 1994 is a File Wrapper Continuation of original U.S. application Ser. No. 07/491,670, filed on Mar. 8, 1990, now abandoned. Priority of the original U.S. application Ser. No. 07/491,670 is claimed pursuant to 35 USC § 120.

FIELD OF THE INVENTION

The invention relates to an apparatus for human physical exercise, and, more particularly, to an apparatus suitable for upper body exercise and providing smooth two directional effort to a user's arms.

BACKGROUND OF THE INVENTION

A variety of stationary exercise machines are known to the art. Examples of such machines include stationary rowing machines and stationary bicycles. These machines typically simulate a common human activity, such as rowing or bicycling. Prior art machines typically lack in adaptability to specialized exercise needs, and in flexibility to accommodate properly to the physical size of the user.

Rowing, for example, is usually a combined upper and lower body exercise, especially where a sliding seat is provided for the rower. Rowing absorbs work from a large muscle mass, including the major muscles of the arms, torso and legs, in a bilaterally symmetrical, rhythmic pattern of movement. A bilaterally symmetric pattern of movement is one that is identical and simultaneous between the sides of the body. Rowing is generally considered to be an excellent exercise, both for cardiovascular benefits as well as overall conditioning. However, rowing has disadvantages for some individuals, such as patients undergoing rehabilitative therapy, who cannot match the range of movement required by the exercise. The rigid definition of the rowing movement does not allow the exerciser to change muscle sets to meet the total intensity level required or to compensate for limited mobility in certain joints.

Another disadvantage of rowing is a high perceived effort required to achieve a given workout intensity level. This high perceived effort results from a number of factors. Rowing imposes an extreme hip and torso flexion at the beginning of each power stroke. The extreme flexion increases intrathoracic pressures which affect cardiac output and make breathing more difficult. Moreover, the workload is imposed in an on and off pattern, on during the expanding power stroke and off during the relaxation phase. The portion of the total workload concentrated in the power strokes is thus large. In addition, rowing imposes a substantial amount of lower back stress on the user.

Stationary bicycles avoid the stop and start sensation of a rowing machine. However, stationary bicycles have their own disadvantages. Cycling does not distribute the workload, but confines it to the leg muscles. Obviously, the user cannot change muscle sets or the pattern of the exercise and maintain the same overall intensity of exercise. Also, stationary bicycles have typically adapted perch type seats, influenced by conventional safety bicycles, as an exercise position. This position is not usually comfortable to the infrequent cyclist, and tends to contribute to a feeling of instability of the machines. The perch type saddle contributes to saddle sores and to a relative lack of stability of the machine.

A handful of prior art devices have attempted to combine a rowing or other type of upper body exercise with a cycling exercise. One prior art device, taught in U.S. Pat. No. 4,188,030, issued Feb. 12, 1980, provides a stationary bicycle with a pair of exercise arms which are linked to the mechanical movement of the cycling exercise. A user can employ the arms or the cycling pedals to drive the movement. Resistance is applied to the movement to increase the workload. However, linkage of the mechanical movements rigidly defines the range of movement of the exercises. In addition, the device taught is substantially a conventional stationary bicycle which has exercise arms. It retains the perch position common to conventional exercise cycles.

Another prior art device is taught in U.S. Pat. No. 4,729, 559, issued on Mar. 8, 1988. It includes exercise arms which are mechanically independent of a cycling exercise. However, the device does not include a way of determining the workload distributed between the cycling exercise and the upper body exercise. The device retains perch type seating common to other stationary bicycles.

Exercise, when appropriately administered, can elicit any one, or a combination, of many beneficial effects. These effects include increased cardiovascular efficiency and endurance, muscle strength and tone, and control of weight. Three different measurements of an individual's exercise may be made which relate to attaining the beneficial effects. These include a measurement of intensity comprising the level of power output of the individual, duration of an individualIs bout of exercise and frequency of bouts of exercise. Intensity and duration may be used as factors in a calculation of total work done or energy expended in a particular bout, i.e., calories. The above noted benefits are enjoyed only when exercise is persisted in at appropriate intensity levels.

U.S. patent application Ser. No. 07/252,169 filed Sep. 30, 1988, assigned to the assignee of the present invention, proposed an exercise machine solving many of the above problems. The exercise machine was directed to maintaining a higher degree of perceived comfort and ease, contributing to greater exercise frequency, while guiding the user in maintaining an appropriate level of intensity in individual bouts. The exercise device provides a cycling action for exercise of the lower body and a pair of exercise arms for upper body exercise. By providing for upper and lower body exercise, the workload on the user is distributed over a large number of muscle groups and muscle actions.

The upper body exercise provided by the exercise machine includes a mechanical movement which applies resistance to each exercise arm in both directions of movement of an exercise arm. In addition, the arms can be moved entirely independently of one another, and can be moved for only a fraction of their overall travel. The mechanical movement allows "unilateral reciprocation" involving movement of the arms oppositely in a rhythmic pattern. The movement also permits "independent unilateral movement", in which no particular relationship exists between movements of the arm and, in fact, in which one arm may remain motionless. A load is applied to the mechanical movement by mechanical connection of the movement to an electrical generator, to which a resistive load is applied.

The mechanical apparatus for upper body exercise in the exercise machine described in U.S. application Ser. No. 07/252,169 generated single directional rotational motion in a predetermined direction from reciprocating movement. The mechanism includes a frame, first and second wheels supported for rotation at spaced locations on the frame, a belt coupling the first and second wheels for rotation, a first wheel cluster including a plurality of wheels engaging the belt for driving the belt in a single direction, a second wheel cluster including a plurality of wheels engaging the belt for driving the belt in the single direction, where the first and second wheel clusters are supported on a reciprocable carrier for movement substantially parallel to the belt between the first and second wheels. Unlike a conventional connection of a crank arm to a pulley, no dead points exist in the mechanism. Where a crank arm is connected off center to a pulley, two points occur during rotation of the pulley where force applied to the crank arm, in either direction, will not contribute to rotation of the pulley. The apparatus of the application has no such problem.

However, use of a flexible belt, such as a chain, can produce an unpleasant jerking sensation to the user stemming from chordal action of the chain. The jerking sensation is a byproduct of changing velocities of sections or linkages of a belt or chain associated with changes in flexing or bending of the section. Chordal action can be eliminated if the chain can be replaced by a system of gears.

SUMMARY OF THE INVENTION

The present invention provides an apparatus for converting reciprocating motion to single direction rotational motion in a predetermined direction. The apparatus comprises a frame, a shaft set for rotation in the frame, a reciprocable arm pivotally mounted to the frame, a first one way clutch mounted on the shaft, a second one way clutch mounted on the shaft, a first rack mounted with respect to the reciprocable arm engaging the first one way clutch for driving the shaft when the first rack is moved in a primary direction, a second rack mounted with respect to the reciprocable arm engaging the second one way clutch for driving the shaft when the second rack is moved in a reciprocal direction, the first and second one way clutches free wheeling against their respective racks when the first rack is moved in the reciprocal direction and the second rack is moved in the primary direction, and means for retaining the first and second racks in engagement with their respective one way clutches.

DETAILED DESCRIPTION OF THE PREFERRED EMBODIMENTS

Figure 1:
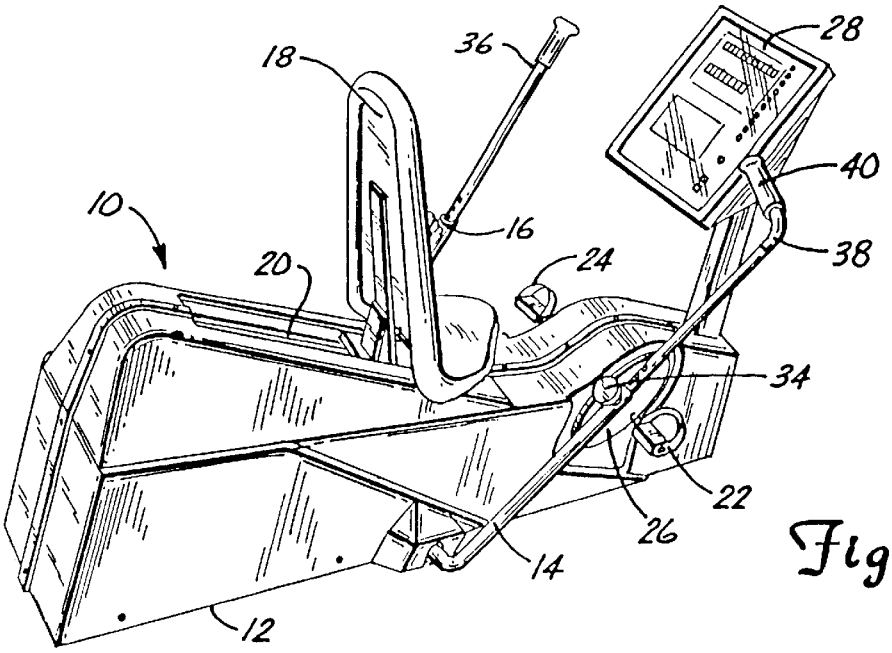
FIG. 1 is a perspective view of the exercise machine of the present invention.
Figure 2:
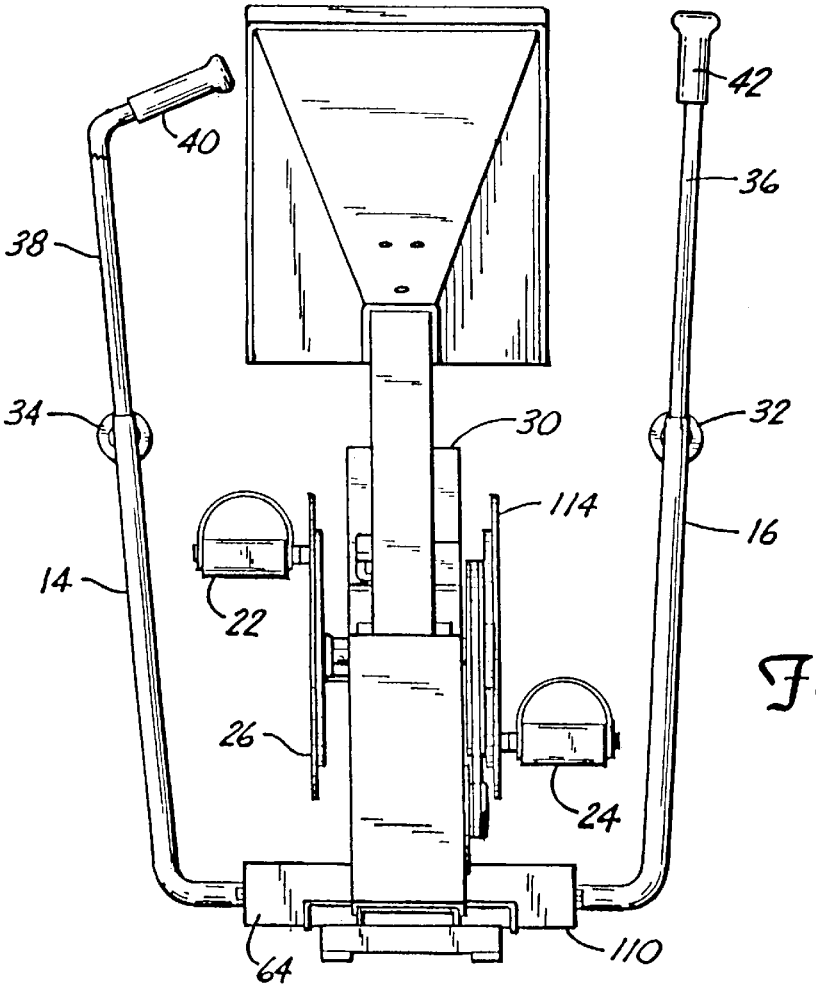
FIG. 2 is a front view of the exercise machine.

FIGS. 1 and 2 illustrate the external components of an exercise machine 10 providing upper and lower body exercise. Exercise machine 10 includes an external body 12 which houses the kinematic elements of machine 10. The lower body exercise is a cycling type exercise provided by pedals 22 and 24. The upper body exercise is a reciprocating arm exercise provided by exercise arms 14 and 16.

An adjustable recumbent saddle 18 is mounted on a positioning track 20 to allow a user to adjust his position. Recumbent saddle 18 supports body weight over a number of points and allows ease in mounting and dismounting exercise machine 10. Recumbent saddle 18 may be positioned with respect to pedals 22 and 24 so as to enhance pedaling efficiency and comfort as part of a cycling exercise. This allows the long-legged user to adjust the saddle position to maintain the same open hip posture and body angle with respect to the cycling action.

Starboard exercise arm 14 and port exercise arm 16 are disposed on opposite sides of exercise machine 10 substantially adjacent recumbent saddle 18. Starboard exercise arm 14 includes an arm extension 38 which may be adjusted in height by adjustment knob 34. Hand grip 40 is provided for gripping by the user. Similarly, port exercise arm 16 includes a similar arm extension 36. Hand grip 42 for gripping by the user with his left hand is provided at the upper end of extension 36. An adjustment knob 32 may be used to adjust the position of extension 36. Hand grips 40 and 42 can be rotated from positions at right angles to arms 14 and 16 to positions in line with arms 14 and 16. Rotation of hand grips 14 and 16 is used to elicit exercise of differing muscle groups.

A display and control panel 28 is provided for easy access and viewing by a user while seated. User display and control panel 28 displays current exercise intensity level, proportion of a target intensity level being met, distribution of effort between the lower body and upper body, terrain profile of the cycle exercise for the lower body, estimated calories consumed and other information of interest to the user. Panel 28 also provides directions for changing the exercise program through controls on the panel. Exercise arms 16 is pivotally disposed on fulcrum 110 and exercise arm 14 is pivotally disposed on fulcrum 64. Exercise arms 14 and 16 are coaxial and allow reciprocating movement with resistance to movement in both directions.

Figure 3:
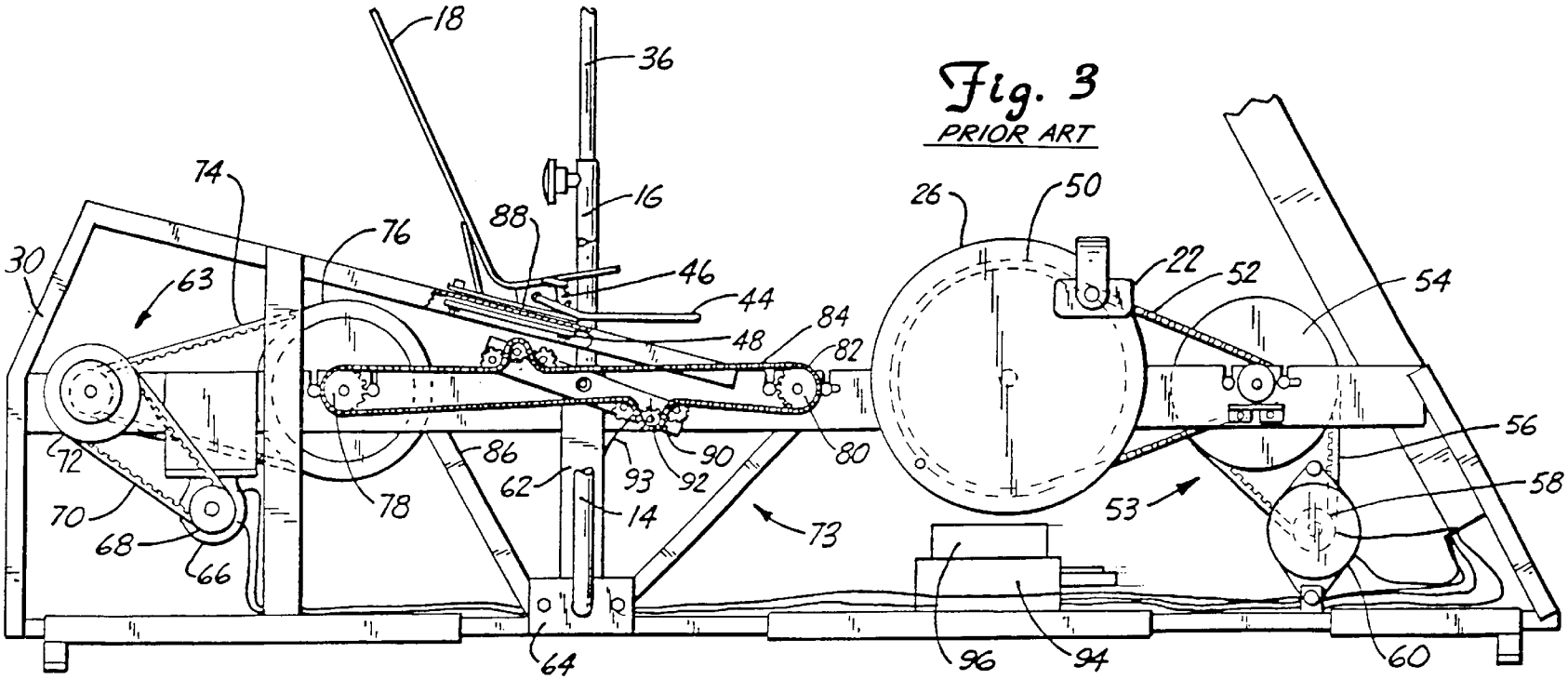
Fig. 3 PRIOR ART
FIG. 3 is a side plan view of the kinematic elements of a prior art exercise machine.

FIG. 3 illustrates the kinematic elements of a prior art exercise machine described in U.S. patent application Ser. No. 07/252,169. The kinematic elements include cycling drive train 53 and exercise arm drive train 63. Exercise arm drive train 53 is mechanically coupled to two substantially identical reciprocating motion to rotational motion translation mechanisms, only one of which, translation mechanism 73 is shown. The description herein of translation mechanism 73 is exemplary of both translation mechanisms.

A frame 30 supports the exercise device on a surface. Cycling drive train 53 includes pedals 22 and 24 described above. Pedal 22 is pivotally mounted on disc 26, which is connected to drive crank set 50. Pedal 24 is similarly linked to drive crank set 50. Crank set 50 guides the user's feet in a rotational direction to simulate bicycling. Crank set 50 is trained with an intermediate reduction gear 54 by chain 52. Intermediate reduction gear 54 is trained with a final drive gear 58 by chain 56. Final drive gear 58 is mounted on the axle to drive generator 60, which produces direct current electric power in response to movement of the cycling action.

Right translation mechanism 73 is disposed on the starboard side of frame 30. Mechanism 73 includes right exercise arm 14, which is linked to right inboard lever arm 62 on fulcrum 64 providing a lever actuated by a user. Lever arm 62 supports for reciprocating movement, an elongated clustered wheel carrier 92. A tension spring 93 is linked between arm 62 and cluster wheel carrier 92 so as to pull cluster wheel carrier 92 toward vertical alignment with lever arm 62. Clustered wheel carrier 92 supports a pair of separated groups or clusters of sprockets 88 and 90. One cluster is designated the primary cluster 88 and the other cluster is designated the complementary cluster 90. The sprockets of clusters 88 and 90 comprise built-in one-way type clutches permitting rotation in one direction only. The three sprockets in each cluster are further disposed at the vertices of a regular triangle to engage a chain 82 on either side thereof.

Chain 82 trains drive gear 78 with idler gear 80. The upper chain lead between idler 80 and drive gear 78 is termed primary lead 84 of chain 82. Primary lead 84 is laced through primary sprocket cluster 88, passing under the two outboard sprockets and over the intermediary sprocket. The outboard sprockets are adapted to rotate freely clockwise. The intermediate sprocket rotates counterclockwise. Thus chain 82 passes freely in the direction of primary lead 84 from idler 80 to drive gear 78.

The lower chain lead between drive gear 78 and idler 80 is termed the complementary chain lead 86 of chain 82. Complementary lead 86 is laced on complementary sprocket cluster 92, passing over the outboard sprockets and under the intermediary sprocket. The outboard sprockets can rotate in the clockwise direction only, intermediary sprocket can rotate in the counterclockwise direction only. Thus chain 82 passes through the cluster in the direction of complementary lead 86 only, that is, from drive gear 78 to idler 80.

Reciprocating movement of cluster wheel carrier 92, without regard to initial direction, results in movement in a single direction of chain 80. Movement of carrier 92 toward drive gear 78 is termed the primary cycle. As the movement of carrier 92 in the primary cycle matches the velocity of chain 82 in primary lead 84, the sprockets of primary sprocket cluster 88 clutch and kinetic energy may be transferred through the sprockets to chain 82. As the speed of carrier 92 in the complementary cycle matches the velocity of chain 82 in complementary lead 86, the sprockets of complementary sprocket cluster 90 clutch and kinetic energy may be applied to chain 82 from lever arm 62. Movement of either sprocket against its respective lead results in the chain passing through the cluster without substantial hinderance.

Reciprocating movement of cluster carrier 92 results in counterclockwise rotation of drive gear 78. This in turn puts drive train 63 into motion. Drive gear 78 is coupled to rotate crank set 76. A chain 74 trains crank set 76 to intermediate reduction gear 72. Intermediate reduction gear 72 is coupled to final drive pulley 68 by timing belt 70. Drive pulley 68 is linked to D.C. generator 66. Accordingly, as exercise arm 14 is pulled toward a user seated in saddle 18, energy may be transferred from primary cluster 88 to chain 82 in primary lead 84. As exercise arm 14 is pushed away from a user seated in saddle 18, energy may be transferred from cluster set 90 to chain 82 in complementary lead 86. In either event, energy is transferred from the user to drive generator 66.

Recumbent saddle 18 is supported on a carriage 48 mounted on track 20. The position of carriage 48 on track 20 is locked by mechanism 46 which may be released for movement by lever 44. Also shown are a variable resistor pack 94 and heat sink 96, the operation of which is explained below.

Figure 4:
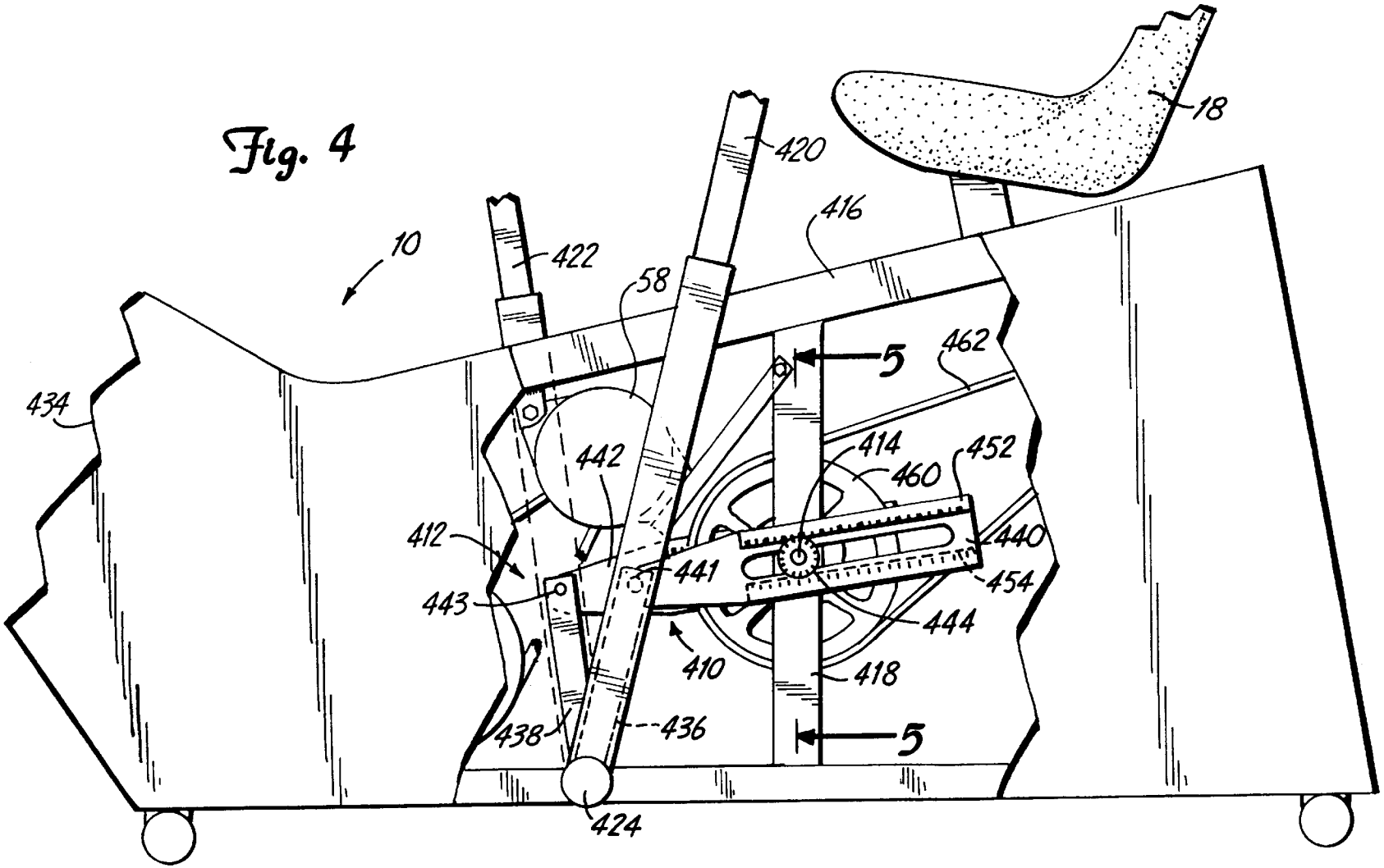
FIG. 4 is a side plan view with partial cut-away of the present exercise machine.
Figure 5:
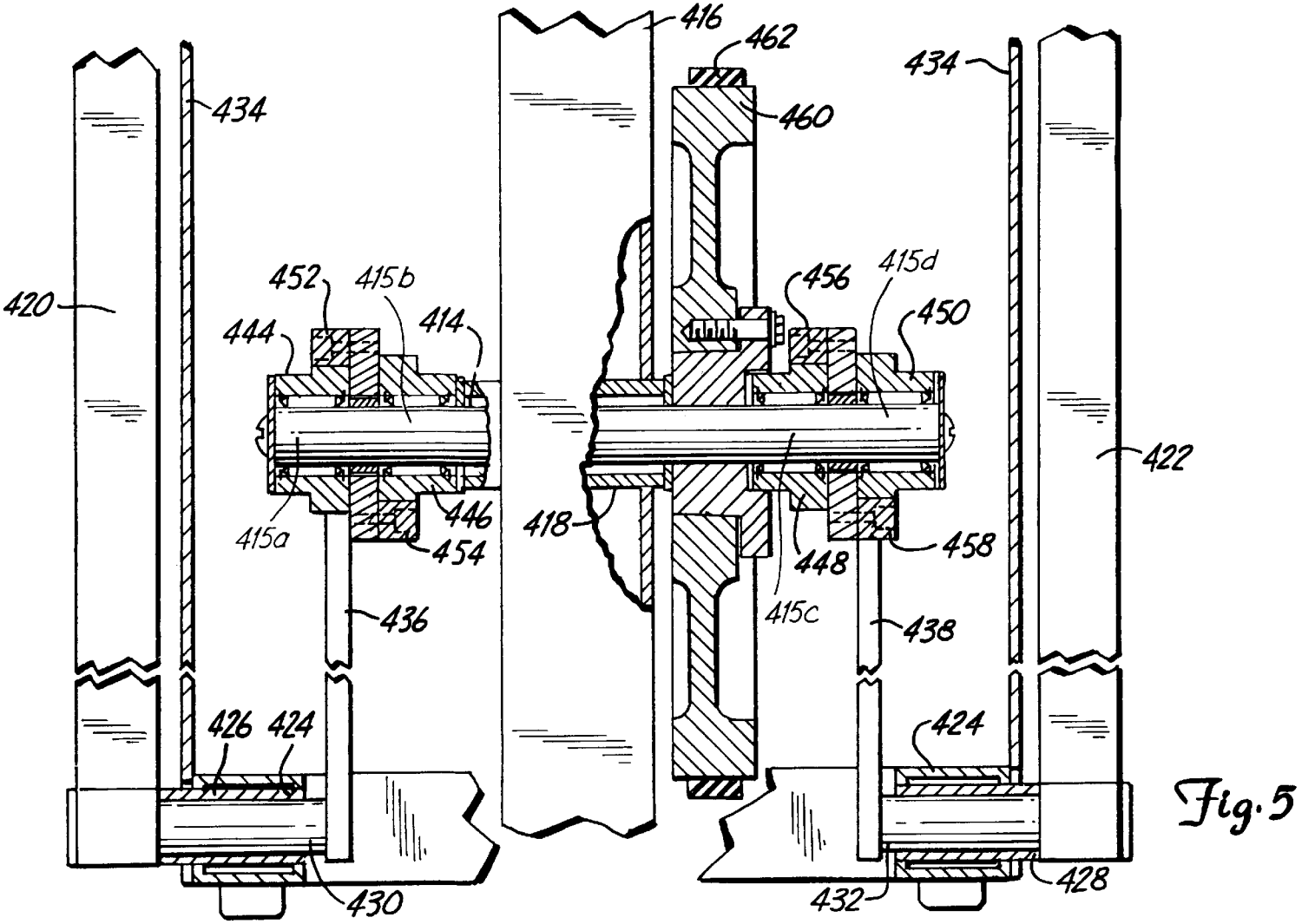
FIG. 5 is a section view taken along line 5—5 of FIG. 4.

FIGS. 4 and 5 illustrate an improved translation mechanisms, embodied in each of two translation mechanisms 410 and 412, for converting reciprocating motion to unidirectional rotation of a shaft 414 set for rotation in a frame 416 of an exercise machine 10. The translation mechanism of the present invention may be directly substituted for the translation mechanism described above with reference to FIG. 3. Translation mechanisms 410 and 412 include exercise arms 420 and 422, respectively, which are pivotally mounted at a fulcrum 424 on frame 416 for independent movement. A user seated on saddle 18 can move either or both of arms 420 and 422 in reciprocating fashion. Fulcrum 424 comprises a pair of sleeve bearings 426 and 428 which support exercise arms 420 and 422 along shafts 430 and 432, respectively.

Shafts 430 and 432 extend through exterior shell 434 into the interior of exercise machine 10. Each shaft is rigidly connected to an arm, shaft 430 with arm 436 and shaft 432 with arm 438. Arms 436 and 438 are in turn rigidly connected to yokes 440 and 442 by suitable fasteners 441 and 443. Yokes 440 and 442 extend from the arms to areas adjacent shaft 414 and move in a reciprocating fashion with the arms. The path followed by connections 441 and 443 is arcuate, and accordingly, yokes 440 and 442 must have sufficient tolerance with respect to shaft 414 to accommodate some twisting of the yokes. Connections 441 and 443 can be made pivoting if guides are provided yokes 440 and 442.

Shaft 414 is mounted through a vertical pillar 418 of frame 416. The shaft 414 has distinct shaft portions 415*a*, 415*b*, 415*c*, and 415*d*. Four one way clutches 444, 446, 448 and 450 are mounted to shaft 414. One way clutch 444 is mounted on the shaft 414 at shaft portion 415*a*; one way clutch 446 is mounted on the shaft 414 at shaft portion 415*b*; one way clutch 448 is mounted on the shaft 414 at shaft portion 415*c*; and one way clutch 450 is mounted on the shaft 414 at shaft portion 415*d*. Movement of yokes 440 and 442 is linked to shaft 414 through interaction of the one way clutches with geared racks 452, 454, 456 and 458, respectively. Racks 452 and 454 are affixed to opposite sides of yoke 440 and racks 456 and 458 are affixed to the opposite major surfaces of yoke 442. Any given one way clutch locks onto shaft 414 with movement of its respective rack in the appropriate direction at a rate of speed sufficiently fast to overtake shaft 414. Otherwise the one way clutch freewheels. Both rack and one way clutch have geared surfaces for nonslip contact with one another. A sprocket 460 is rigidly mounted to shaft 414 for engaging a drive belt 462 to drive a generator (shown in FIG. 3).

Where one of one way clutches 444, 446, 448 and 450 freewheels during transmission of power to shaft 414 by another of the one way clutches, the freewheeling one clutch associated with the power transmitting clutch is pressed onto shaft 414 counterbalancing separating force generated between a rack and the power transmitting one way clutch. Associated pairs of clutches are the pair of clutches including clutches 444 and 446, and the pair of clutches 448 and 450. Associated pairs of clutches are the pair of clutches which engage the two racks of a yoke.

Figure 6:
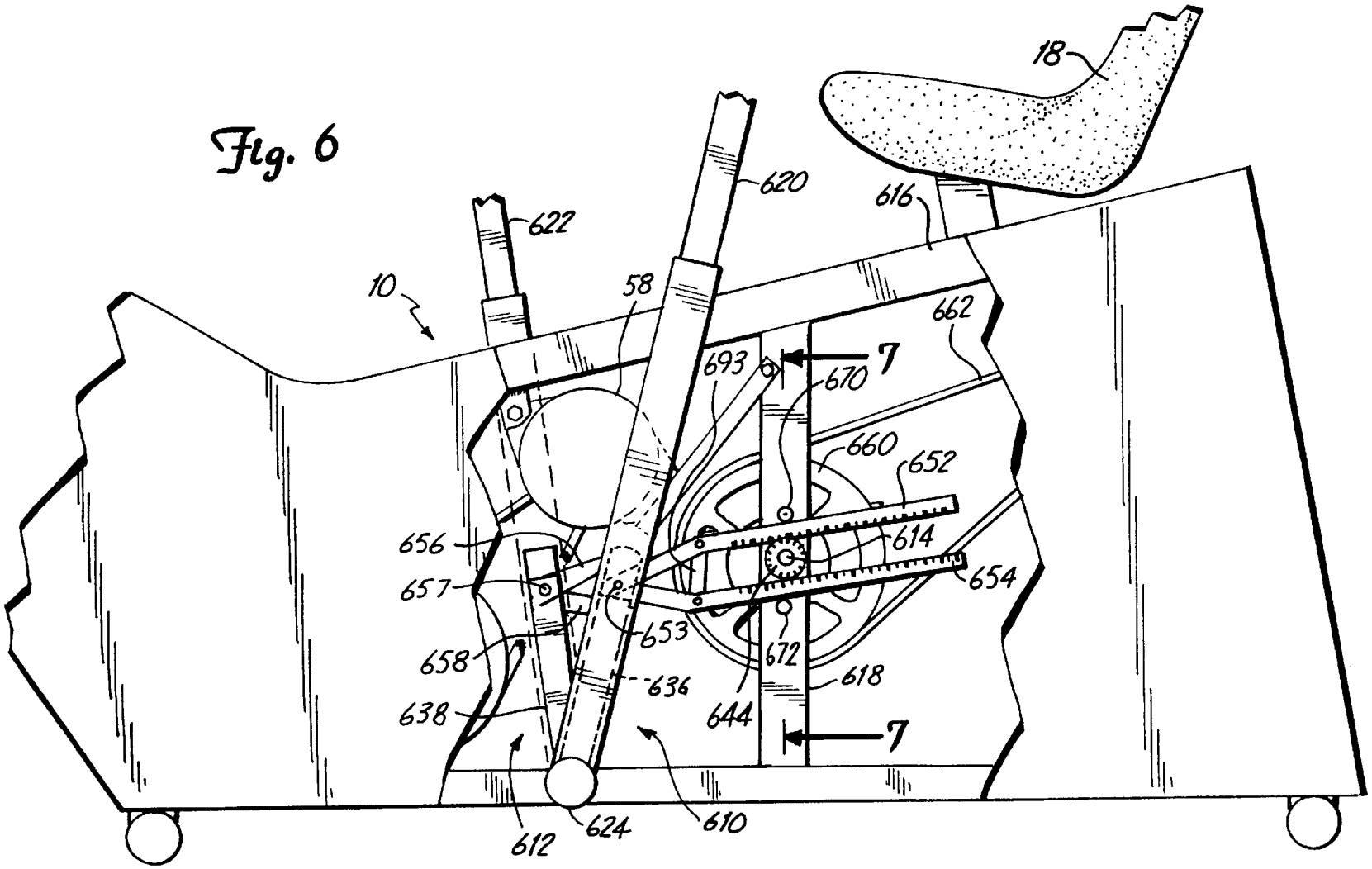
FIG. 6 is a side plan view with partial cut-away of the present exercise machine.
Figure 7:
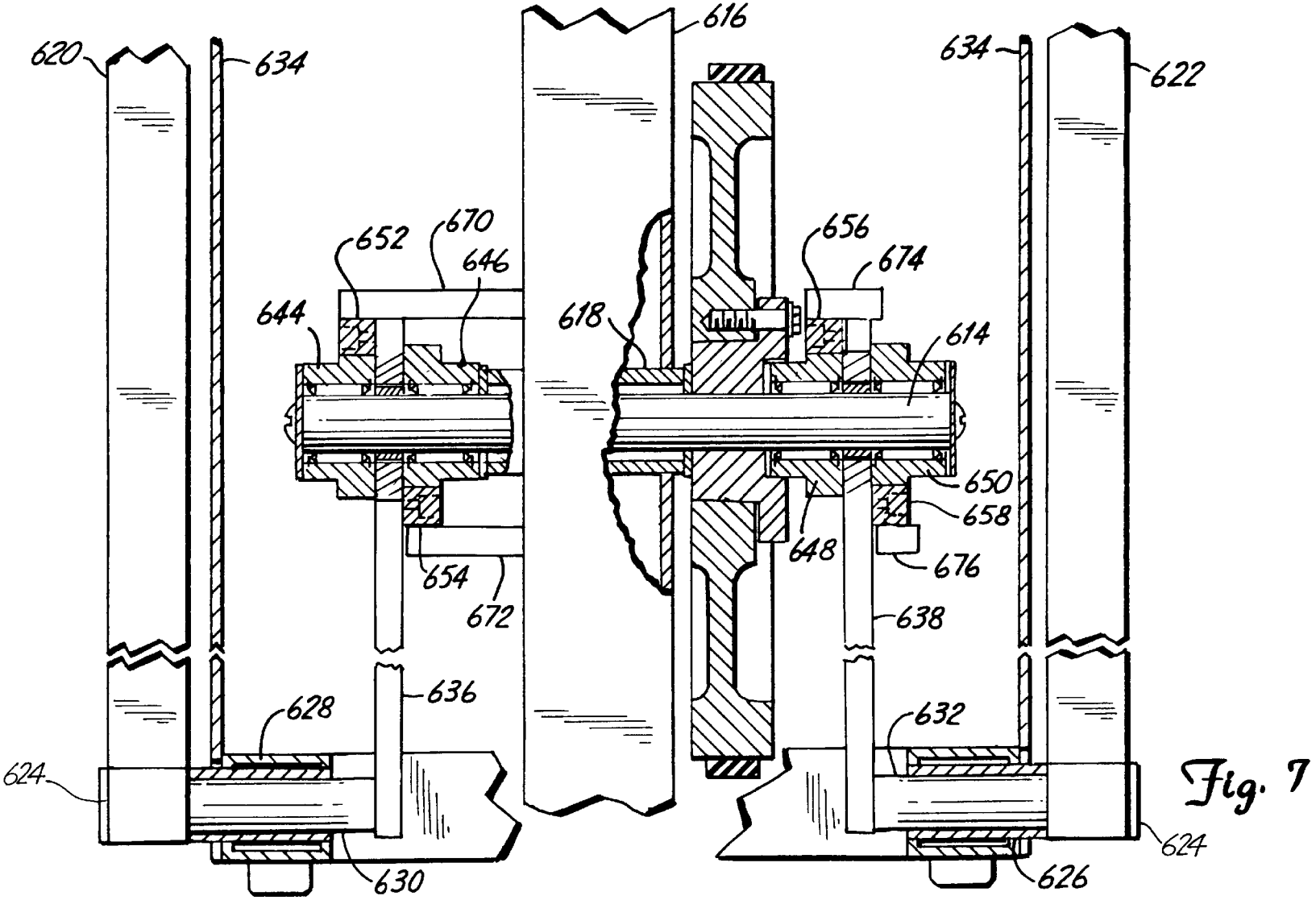
FIG. 7 is a section view taken along line 7—7 of FIG. 6.

FIGS. 6 and 7 illustrate a second embodiment of the improved translation mechanism, utilized in each of two translation mechanisms 610 and 612. Translation mechanisms 610 and 612 convert reciprocating motion to unidirectional rotation of a shaft 614 set for rotation in a frame 616 of an exercise machine 10. Translation mechanisms 610 and 612 include exercise arms 620 and 622, respectively, which are pivotally mounted on a fulcrum 624 on frame 616 for independent movement. A user seated on saddle 18 can move either or both of arms 620 and 622 in reciprocating fashion. Fulcrum 624 comprises a pair of sleeve bearings 628 and 626 which support exercise arms 620 and 622 along shafts 630 and 632, respectively.

Shafts 630 and 632 extend through exterior shell 634 into the interior of exercise machine 10. Each shaft is rigidly connected to an arm, shaft 630 with arm 636 and shaft 632 with arm 638. Arms 636 and 638 are in turn rigidly connected to two racks. Arm 636 supports racks 652 and 654 at fastener 653. Arm 638 supports racks 656 and 658 at fastener 657. Racks 652, 654, 656 and 658 extend from arms 636 and 638 to areas adjacent shaft 614 and move in a reciprocating fashion with the arms. Pairs of racks, e.g. racks 652 and 654, are held parallel with respect to one another, e.g. by strut 693 between racks 652 and 654.

Shaft 614 is mounted through a vertical pillar 618 of frame 616. Four one way clutches 644, 646, 648 and 650 are mounted to shaft 614. Racks 652, 654, 656 and 658 are linked to shaft 614 through one way clutches 644, 646, 648 and 650, respectively. Racks and one way clutches are geared for nonslip connection. Racks 652 and 654 are mounted to opposite sides of arm 636 and racks 656 and 658 are mounted to opposite sides of arm 638. Any given one way clutch locks onto shaft 614 with movement of its respective rack in the appropriate direction at a rate of speed sufficiently fast to overtake shaft 614 in the predetermined direction of rotation. Otherwise the one way clutch freewheels. A sprocket 660 is rigidly mounted to shaft 614 for engaging a drive belt 662 to drive a generator (shown in FIG. 3).

Separating force generated between a rack and the power transmitting one way clutch is counterbalanced by idler wheels 670, 672, 674 and 676 which are supported to rotate against racks 652, 654, 656 and 658, respectively.

Figure 8:
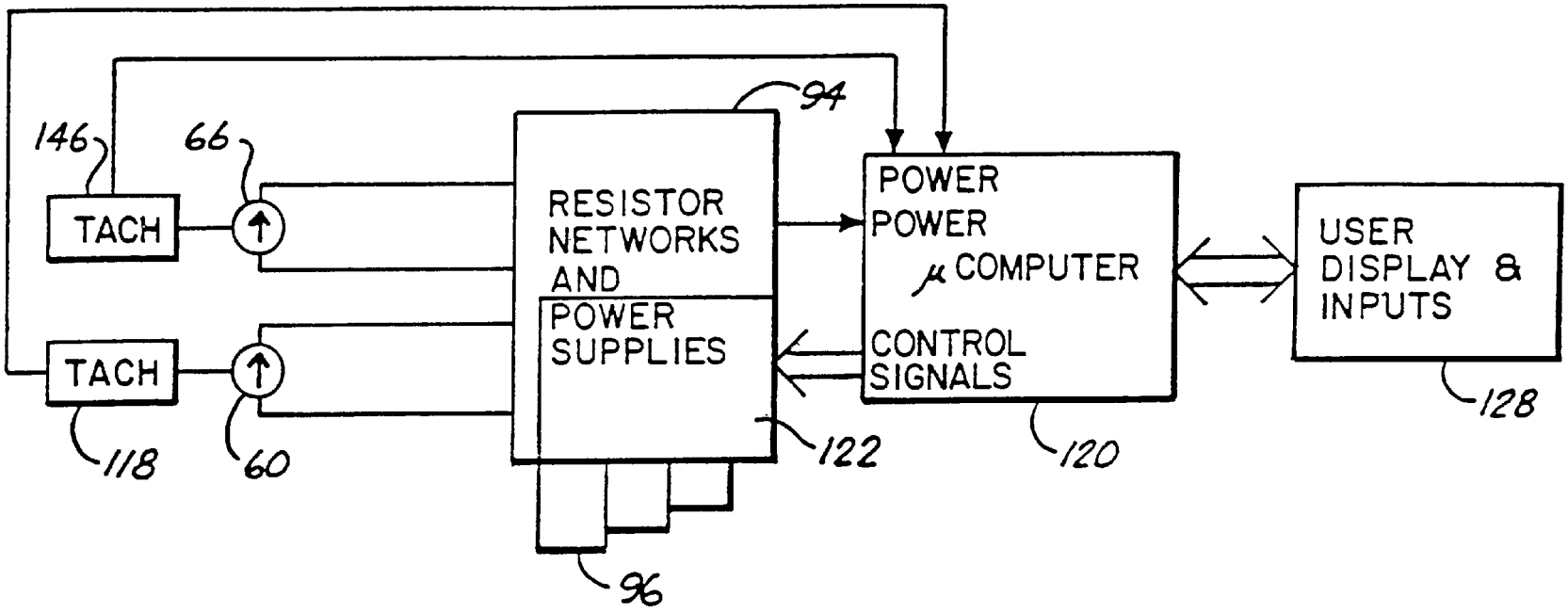
Fig. 8 PRIOR ART
FIG. 8 is a schematic of control and load circuitry.

FIG. 8 illustrates the electrical system of exercise machine 10 in which translation mechanisms of the present invention are advantageously employed. DC generators 60 and 66 are coupled to tachometers 118 and 116 respectively. Measurements there from are transmitted to a microcomputer 120 housed in display panel 28. DC generators 60 and 66 are connected across a variable resistor pack 94 which applies selected loads independently to generators 60 and 66 at the direction of microcomputer 120. Heat produced in variable resistor pack 94 is dissipated through a heat sink 96. Microcomputer 120 provides control signals to variable resistor pack 94 to vary the instantaneous resistance shown in generators 60 and 66. Resistances may be varied to determine the total load and the variability of the load to provide simulated terrain profiling. Microcomputer 120 is also coupled to generators 60 and 66 through a power supply 122 and derives all power for its operation by actuation of generators 60 and 66. This allows elimination of a battery from within the exercise device or for any need to connect the device to an external power source. Microcomputer 120 drives user display 28 and receives control inputs from display 28 to determine the program it will operate.

Figure 9:
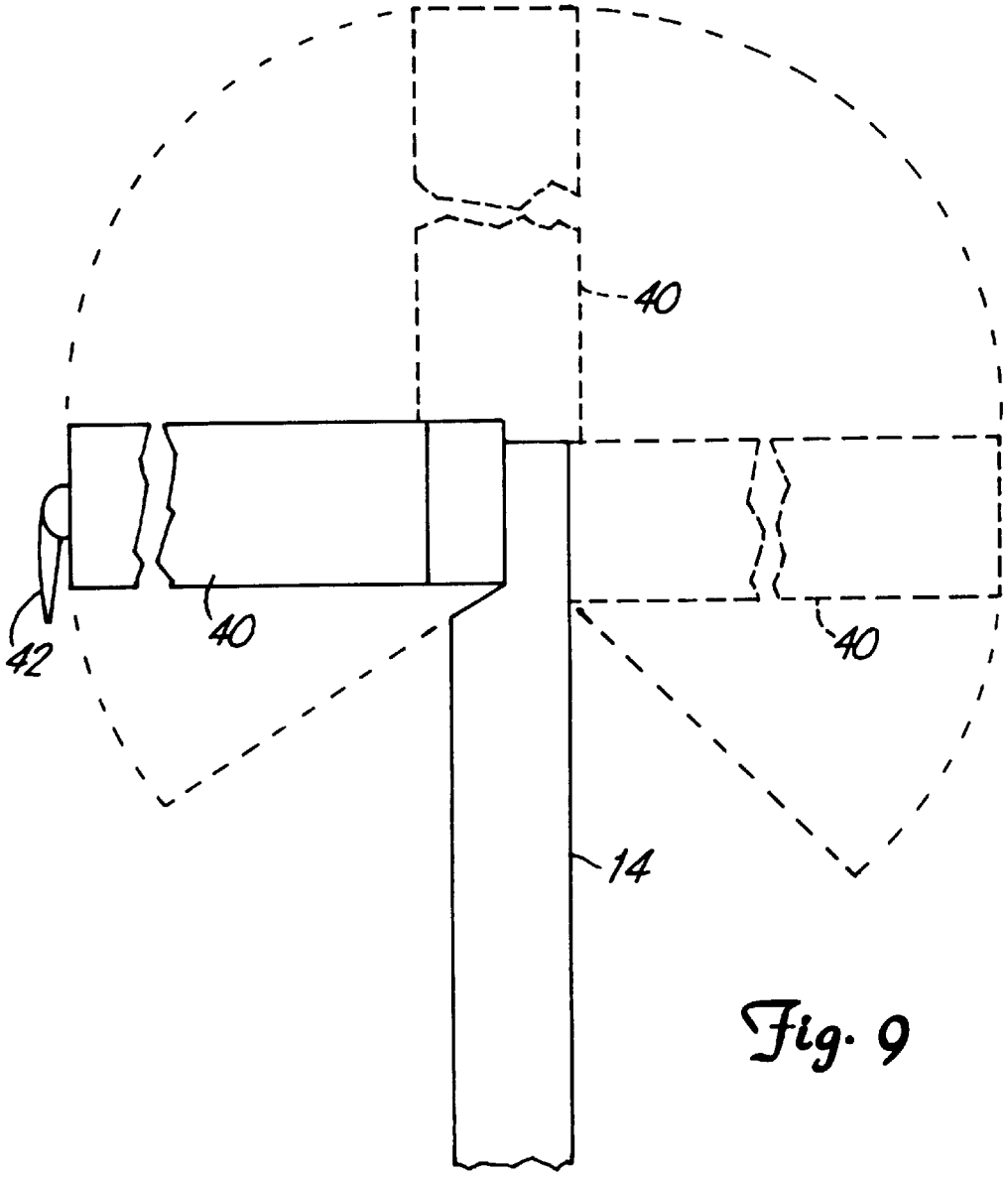
FIG. 9 is a side view of a movable grip.

FIG. 9 illustrates a positionable grip 40 mounted on exercise arm 14. Upon release of lever 42, grip 40 may freely be positioned at any point along a 270 degree arc, 135 degrees in each direction from the vertical, and locked into a selected position by closure of lever 42. A hirth coupling may advantageously be employed for this purpose.

Although the present invention has been described with reference to preferred embodiments, workers skilled in the art will recognize that changes may be made in form and detail without departing from the spirit and scope of the invention.

What is claimed is:

1. An apparatus for converting reciprocating motion to single direction rotational motion, the apparatus comprising:

a frame;

a shaft set for rotation in the frame;

a first one way clutch mounted on the shaft;

a second one way clutch mounted on the shaft;

a first rack engaging the first one way clutch for driving the shaft when moved in a primary direction at a rate of speed sufficiently fast to overtake the shaft;

a second rack engaging the second one way clutch for driving the shaft when moved in a reciprocal direction at a rate of speed sufficiently fast to overtake the shaft;

a first actuator in working relation with the racks;

a yoke, the yoke in working relation with the racks and the first actuator, and the first rack and the second rack located on opposing outer sides of the yoke;

where one of the first and second one way clutches freewheels during transmission of power to the shaft by the other of the first and second one way clutches; and a mechanism for counterbalancing separating force generated between the power transmitting clutch and the one of the first and second racks engaging the power transmitting clutch, the mechanism for counterbalancing comprising the freewheeling clutch and the one of the first and second racks engaging the freewheeling clutch.

2. The apparatus of claim 1 wherein the freewheeling clutch is pressed onto the shaft to counterbalance the separating force.

3. The apparatus of claim 1 wherein:

the shaft has a longitudinal axis;

the shaft comprises a first portion and a second portion;

the first one way clutch is capable of acting on the first portion of the shaft;

the second one way clutch is capable of acting on the second portion of the shaft; and the first portion of the shaft and the second portion of the shaft are longitudinally offset from each other along the longitudinal axis of the shaft.

4. The apparatus of claim 1 wherein the mechanism for counterbalancing consists of the freewheeling clutch, the one of the first and second racks engaging the freewheeling clutch, and a yoke that links the first rack and the second rack.

5. The apparatus of claim 1 wherein:

the first one way clutch and the second one way clutch are longitudinally offset from each other along the shaft; and the mechanism for counterbalancing consists of the freewheeling clutch, the one of the first and second racks engaging the freewheeling clutch, and a yoke that links the first rack and the second rack.

6. An apparatus for converting reciprocating motion to single direction rotational motion, the apparatus comprising:

a frame;

a shaft set for rotation in the frame;

a first one way clutch mounted on the shaft;

a second one way clutch mounted on the shaft;

a third one way clutch mounted on the shaft;

a fourth one way clutch mounted on the shaft;

a first rack engaging the first one way clutch for driving the shaft when moved in a primary direction at a rate of speed sufficiently fast to overtake the shaft;

a second rack engaging the second one way clutch for driving the shaft when moved in a reciprocal direction at a rate of speed sufficiently fast to overtake the shaft;

a first actuator in working relation with the first rack and the second rack;

a third rack engaging the third one way clutch for driving the shaft when moved in a primary direction at a rate of speed sufficiently fast to overtake the shaft;

a fourth rack engaging the fourth one way clutch for driving the shaft when moved in a reciprocal direction at a rate of speed sufficiently fast to overtake the shaft;

a second actuator in working relation with the third rack and the fourth rack;

a yoke, the yoke in working relation with the third rack, the fourth rack, and the second actuator, the third rack and the fourth rack located on opposing outer sides of the yoke;

where one of the first and second one way clutches freewheels during transmission of power to the shaft by the other of the first and second one way clutches; and a mechanism for counterbalancing separating force generated between the power transmitting clutch and the one of the first and second racks engaging the power transmitting clutch, the mechanism for counterbalancing comprising the freewheeling clutch and the one of the first and second racks engaging the freewheeling clutch.

7. A method of making an exercise machine that is capable of converting reciprocating motion to single direction rotational motion in a predetermined direction, the method comprising:

attaching a shaft to a frame for rotation of the shaft relative to the frame;

mounting a first one way clutch and a second one way clutch on the shaft;

engaging the first one way clutch with a first rack for driving the shaft when the first rack is moved in a primary direction at a rate of speed sufficiently fast to overtake the shaft;

engaging the second one way clutch with a second rack for driving the shaft when the second rack is moved in a reciprocal direction at a rate of speed sufficiently fast to overtake the shaft;

positioning an actuator in working relation with the racks; and mounting the racks on opposing sides of a yoke that is in working relation with the actuator to retain the second rack in engagement with the second one way clutch when the second one way clutch is not freewheeling by maintaining the first rack in engagement with the first one way clutch when the first one way clutch is freewheeling.

8. An exercise machine made in accordance with the method of claim 7.

9. An apparatus for converting reciprocating motion to single direction rotational motion in a predetermined direction, the apparatus comprising:

a frame;

a shaft set for rotation in the frame;

a first one way clutch mounted on the shaft;

a second one way clutch mounted on the shaft;

a first rack engaging the first one way clutch for driving the shaft when moved in a primary direction at a rate of speed sufficiently fast to overtake the shaft;

a second rack engaging the second one way clutch for driving the shaft when moved in a reciprocal direction at a rate of speed sufficiently fast to overtake the shaft;

an actuator in working relation with the racks; and a mechanism for retaining the first rack in engagement with the first one way clutch, the mechanism for retaining comprising a yoke, the first and second racks located on opposing outer sides of the yoke.

10. The apparatus of claim 9 and further comprising:

an electrical generator having a rotational element;

a variable load connected across the electrical generator; and a mechanical linkage from the shaft to the rotational element.

11. The apparatus of claim 9 wherein the mechanism for retaining also retains the second rack in engagement with the second one way clutch.

12. The apparatus of claim 9 wherein the first rack retains the second rack in engagement with the second one way clutch when the first one way clutch is freewheeling.

13. The apparatus of claim 12 wherein the second rack retains the first rack in engagement with the first one way clutch when the second one way clutch is freewheeling.

14. The apparatus of claim 9 wherein the actuator comprises a reciprocable arm pivotally mounted to the frame.

15. An apparatus for converting reciprocating motion to single direction rotational motion, the apparatus comprising:

a frame;

a shaft set for rotation in the frame;

a first one way clutch mounted on the shaft;

a second one way clutch mounted on the shaft;

a first rack engaging the first one way clutch for driving the shaft when moved in a primary direction at a rate of speed sufficiently fast to overtake the shaft;

a second rack engaging the second one way clutch for driving the shaft when moved in a reciprocal direction at a rate of speed sufficiently fast to overtake the shaft;

an actuator in working relation with the racks;

a yoke in working relation with the actuator and the racks;

where one of the first and second one way clutches freewheels during transmission of power to the shaft by the other of the first and second one way clutches; and a mechanism for counterbalancing separating force generated between the power transmitting clutch and the one of the first and second racks engaging the power transmitting clutch, the first rack and the second rack being located on opposing outer sides of the yoke.

16. The apparatus of claim 15 wherein:

the first rack counterbalances separating force generated between the second rack and the second one way clutch when the first one way clutch is freewheeling; and the second rack counterbalances separating force generated between the first rack and the first one way clutch when the second one way clutch is freewheeling.

17. The apparatus of claim 15 wherein the actuator comprises a reciprocable arm pivotally mounted to the frame.

* * * * *